US011352941B2

(12) United States Patent
Garvin et al.

(10) Patent No.: US 11,352,941 B2
(45) **Date of Patent: *Jun. 7, 2022**

(54) HEAVY FUEL ROTARY ENGINE WITH COMPRESSION IGNITION

(71) Applicant: Rotary Research Group LLC, Joplin, MO (US)

(72) Inventors: P. Tyson Garvin, Joplin, MO (US); Timothy C. Stamps, Carl Junction, MO (US)

(73) Assignee: Rotary Research Group LLC, Joplin, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/135,087

(22) Filed: Dec. 28, 2020

(65) Prior Publication Data

US 2021/0363912 A1 Nov. 25, 2021

Related U.S. Application Data

(63) Continuation of application No. 16/043,771, filed on Jul. 24, 2018, now Pat. No. 10,907,531.

(51) Int. Cl.
*F02B 3/00* (2006.01)
*F02B 3/08* (2006.01)
(Continued)

(52) U.S. Cl.
CPC ..... *F02B 3/08* (2013.01); *F02B 53/02* (2013.01); *F02B 55/02* (2013.01); *F02B 55/08* (2013.01); *F02B 2053/005* (2013.01)

(58) Field of Classification Search
CPC .. F02B 3/08; F02B 55/02; F02B 53/02; F02B 55/08; F02B 2053/005
See application file for complete search history.

(56) References Cited

U.S. PATENT DOCUMENTS 2,988,065 A 6/1961 Wankel et al.
3,142,440 A 7/1964 Schagg
(Continued)

FOREIGN PATENT DOCUMENTS

DE 19644446 A1 * 6/1997 ..... F02D 19/081
JP 55-101703 A1 8/1980
WO WO-03016678 A1 * 2/2003 ..... F01C 19/04

OTHER PUBLICATIONS

"A Review of Heavy-Fueled Rotary Engine Combustion Technologies" by Choi-Bum M. Kweon, Army Research Laboratory, May 2011, ARL-TR-5546.

(Continued)

*Primary Examiner* — Matthew T Largi
(74) *Attorney, Agent, or Firm* — Foley & Lardner LLP

(57) ABSTRACT

A rotary engine that starts and operates on compression-ignition of a heavy fuel without a secondary ignition source. The rotary engine includes a rotor housing that forms an epitrochoidal-shaped chamber having linear side portions extending between rounded end portions. A three-flanked rotor is disposed in the chamber to rotate and operate in a manner similar to that of a common Wankel-style rotary engine. The rotor and chamber are configured to provide a compression ratio sufficient to produce compression-ignition of a heavy fuel. The rotor includes apex seal and side seal mounting blocks formed from hardened materials and that are simply removable from the rotor for replacing apex and side seals. The apex seals may include multiple non-parallel seal members at each apex and the apex seals and the side seals may overlap or intersect a corner seal to increase sealing under high compression loads produced by the rotor/chamber configuration.

16 Claims, 10 Drawing Sheets

(51) Int. Cl.

| | |
|---|---|
| ***F02B 53/02*** | (2006.01) |
| ***F02B 55/02*** | (2006.01) |
| ***F02B 55/08*** | (2006.01) |
| *F02B 53/00* | (2006.01) |

(56) References Cited

U.S. PATENT DOCUMENTS

| | | | | |
|---|---|---|---|---|
| 3,196,854 | A * | 7/1965 | Novak | F02B 53/00 418/270 |
| 3,249,095 | A | 5/1966 | Hamada | |
| 3,270,719 | A | 9/1966 | Hamada | |
| 3,358,439 | A | 12/1967 | De Castelet De Coye | |
| 3,903,847 | A | 9/1975 | Olenzek et al. | |
| 3,918,415 | A * | 11/1975 | Ishida | F02B 53/00 418/253 |
| 3,990,422 | A | 11/1976 | Watson et al. | |
| 3,990,817 | A | 11/1976 | Ruf et al. | |
| 3,994,266 | A * | 11/1976 | Jones | F01C 19/04 123/205 |
| 3,996,898 | A | 12/1976 | Hart et al. | |
| 4,037,412 | A * | 7/1977 | Jones | F02B 69/02 60/605.1 |
| 4,070,995 | A | 1/1978 | Loyd, Jr. | |
| 4,417,862 | A * | 11/1983 | Fenton | F01C 1/22 418/54 |
| 4,733,534 | A * | 3/1988 | Southard | F01C 11/008 60/595 |
| 5,305,721 | A | 4/1994 | Burtis | |
| 5,399,078 | A * | 3/1995 | Kuramasu | F02B 55/00 418/61.2 |
| 6,125,813 | A | 10/2000 | Louthan et al. | |
| 8,523,546 | B2 | 9/2013 | Shkolnik et al. | |
| 8,904,991 | B2 * | 12/2014 | Al-Hawaj | F01C 21/08 123/200 |
| 10,145,291 | B1 * | 12/2018 | Thomassin | F02B 19/1023 |
| 2002/0189578 | A1 * | 12/2002 | Szorenyi | F01C 1/22 123/241 |
| 2010/0269782 | A1 | 10/2010 | Minick et al. | |
| 2013/0028772 | A1 * | 1/2013 | Julien | F01C 21/08 418/61.2 |

OTHER PUBLICATIONS

"Adiabatic Wankel Type Rotary Engine Phase II Final Report" by Kama, Badgley and Doup, Adiabatics, Inc., NASA Contract NAS3-24880.

"DARPA Awards $1 M to Pratt & Whitney Rocketdyne to Design Engine for Transformer Vehicle"; http://www.greencarcongress.com/2010/1O/tx-20101020.html.

"Developed Technologies of the New Rotary Engine (RENESIS)" by Ohkubo, Tashim, Shimizu, Fuse & Ebino, Mazda Motor Corp, SAE Technical Paper Series 20014-01-1790.

"Geometry of the Wankel Rotary Engine" by Drogosz, Journal of KONES Powertrain and Transport, vol. 17, No. 3 2010.

"Houaing Mods & Prep"; Mazda RX-7. pp. 82-93.

"Mazda 4-Rotor Rotary Engine for the Le Mans 24-Hour Endurance Race" by Shimizu, Tadokoro, BNaanish and Funamoto, Mazda Motor Corp., #920309.

"NASA's Rotary Engine Technology Enablement Program—1983-1991 "; NASA Technical Memorandum 10562; Edward A. Willis & John J. McFadden.

Present Status and Future View of Rotary Engines by Nago, Ohzeki and Niura, Mazda Motor Corp.

"Rotary Engine 101: Mechanics", Rotary Engine Ilustrated; http://www.rotaryengineillustrated.com/RE101 pages/2a-mech-cycle.html.

"Rotary Engine Performance Limits Predicted by a Zero-Dimensional Model" NASA Contractor Report 189129.

"Stratified Charge Rotary Engine Critical Technology Enablement"; NASA Contractor Report 189106—vol. 11.

"Stratified Charge Rotary Engine Critical Technology Enablement"; NASA Contractor Report 189106—vol. I.

"The Stratified Charge Rotary Engine" by Walker and Mount; Rotary Engine Division, John Deere Technologies Int'l Inc.

"The Wankel Rotary Engine", Chapter 7, pp. 261-281.

"The X-series Rotary Diesel Engine"; Alexander Shkolnik, President, CEO, Liquid Piston.

"This Might Be the Weirdest Engine Rolls-Royce Ever Made" by Jason Torchinsky, Jul. 17, 2017.

Engine; 57GO1 X-501 through 57GO1 X-509.

Mazda RX-7: Mazda Rotary' The Rotary Rocket.pp. 8-14.

Pressure in diesel engines—Bosch Media Service press release, Nov. 28, 2013, Bosch worldwide, http://www.bosch-presse.de/pressportal/de/en.

Rotary Engine 101: Ignition, Rotary Engine Ilustrated; http://www.rotaryengineillustrated.com/RE101pages/5-ignition101.html.

Rotary Engine 101: Mechanics, Rotary Engine Ilustrated; http://www.rotaryengineillustrated.com/RE101pages/2-mechanics101.html.

Rotary Engine 101: Ports, Rotary Engine Ilustrated; http://www.rotaryengineillustrated.com/RE101pages/4-ports101.html.

Rotary Engine 101: The Cycle, Rotary Engine Ilustrated; http://www.rotaryengineillustrated.com/RE101pages/3-thecycle101.html.

* cited by examiner

HEAVY FUEL ROTARY ENGINE WITH COMPRESSION IGNITION

CROSS-REFERENCE TO RELATED APPLICATIONS

The present application is a continuation of U.S. patent application Ser. No. 16/043,771, filed Jul. 24, 2018, the disclosure of which is incorporated herein by reference in its entirety.

BACKGROUND

Internal combustion engine design and development has long favored reciprocating piston engine configurations over rotary engine configurations, also referred to as Wankel engines after the inventor Felix Wankel. However, as manufacturing and design techniques and material technologies advance, rotary engine designs become more interesting and potentially useful for powering a wide variety of devices and vehicles.

Rotary engines can provide a variety of advantages including, for example, high power-density, low vibration, design simplicity, fewer components, compact size, and low engine weight. However, disadvantages like low fuel efficiency and frequent maintenance requirements have historically plagued the operation of such designs.

Much of the research, development, and commercial application of rotary engines has been directed toward designs that operate on spark-ignition of fuels like gasoline. A multitude of organizations such as the United States National Aeronautics and Space Administration (NASA), the United States Army Research Laboratory, the Curtis-Wright Corporation, and the John Deere Company (Deere & Company), among others have also investigated heavy fuel applications of rotary engines, e.g., fuels such as diesel, Jet-A, Jet-A1, JP-5, and JP-8, among others. However, the research and development has thus far failed to produce a viable, compression-ignition, heavy-fuel rotary engine.

A major difficulty encountered with heavy fuel applications is that the compression ratio needed to support compression ignition of the heavy fuel has not been achievable. For example, geometries of the rotor and housing that provide sufficient compression ratios also produce a long, thin combustion chamber which could result in incomplete burning of the fuel, small engine displacement relative to the engine size, heavy mechanical strain on the engine components, and greater component size and strength requirements, and greater engine complexities, among others. Many attempts have been made to produce a rotary engine capable of starting and operating on heavy fuels, but have concluded that such an engine is not practical and requires use of ignition sources, such as spark-plugs glow-plugs, pre-combustion chambers, or other internal and/or external ignition aids. See for example, U.S. Pat. No. 6,125,816 to Louthan et al. and "A Review of Heavy-Fueled Rotary Engine Combustion Technologies" by Chol-Bum M. Kweon, Army Research Laboratory ARL-TR-5546, May 2011 (hereinafter referred to as Kweon).

SUMMARY

Exemplary embodiments are defined by the claims below, not this summary. A high-level overview of various aspects thereof is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes, among other things, a rotary engine that starts and operates using compression ignition of heavy fuels without use of another internal or external ignition aid.

The rotary engine comprises a rotary engine of a design commonly referred to as an eccentric, pistonless, or Wankel-type rotary engine having a rotor housing that defines an epitrochoidal-shaped, two-lobed chamber in which a three-sided rotor is disposed to rotate in a planetary motion about an eccentric drive shaft. The epitrochoidal shape of the chamber is configured to provide generally circular, rounded endwalls with parallel, linear sidewalls extending therebetween thereby eliminating an inwardly protruding bump or pinching in of the chamber walls found in known rotary engine housing configurations.

The rotor includes three flanks that meet at three respective apexes. The chamber and the rotor are configured to provide compression ratios sufficient to produce compression-ignition of a heavy fuel, e.g. compression ratios greater than 13:1 or greater than about 15:1 or greater than about 18:1, without the use of an additional ignition source such as a spark-plug or other internal or external ignition aid.

A fuel injection system is provided that includes a plurality of fuel injection nozzles disposed along a wall of the chamber to align with a combustion region formed between the rotor flank and the chamber wall. The fuel injection system is configured to provide fuel injection pressures greater than about 300 pounds per square inch (psi). Air induction systems, such as turbo chargers or super chargers among others, may also be provided to increase pressures within an intake region of the chamber.

The rotor housing further includes a pair of end plates that each couple to and enclose a respective end of the housing. Each of the end plates forms a port that is positioned to align with either an intake chamber or an exhaust chamber formed between the rotor flanks and the wall of the chamber. The end plates are configured to be interchangeable or to allow operation of the rotor in either a clockwise or counter-clockwise direction such that the port formed in the end plate can be employed as either an intake or an exhaust port.

Apex seals are provided at each apex of the rotor and extend between the apex and the wall of the chamber. The apex seals are disposed in an apex-seal holder comprised of a hardened, wear-resistant material. The holder is removably coupled to the rotor to enable simple removal from the rotor along with the associated apex seals and thus simple replacement of worn apex seals. Side seals are provided on each end face of the rotor extending into contact with the respective end plate and are similarly disposed in side-seal holders that are simply removable and replaceable on the rotor. The apex and side seals may be configured to overlap with a corner seal at or adjacent to the apexes of the rotor to increase sealing between chambers.

DESCRIPTION OF THE DRAWINGS

Illustrative embodiments are described in detail below with reference to the attached drawing figures, and wherein.

DETAILED DESCRIPTION

Figure 1:
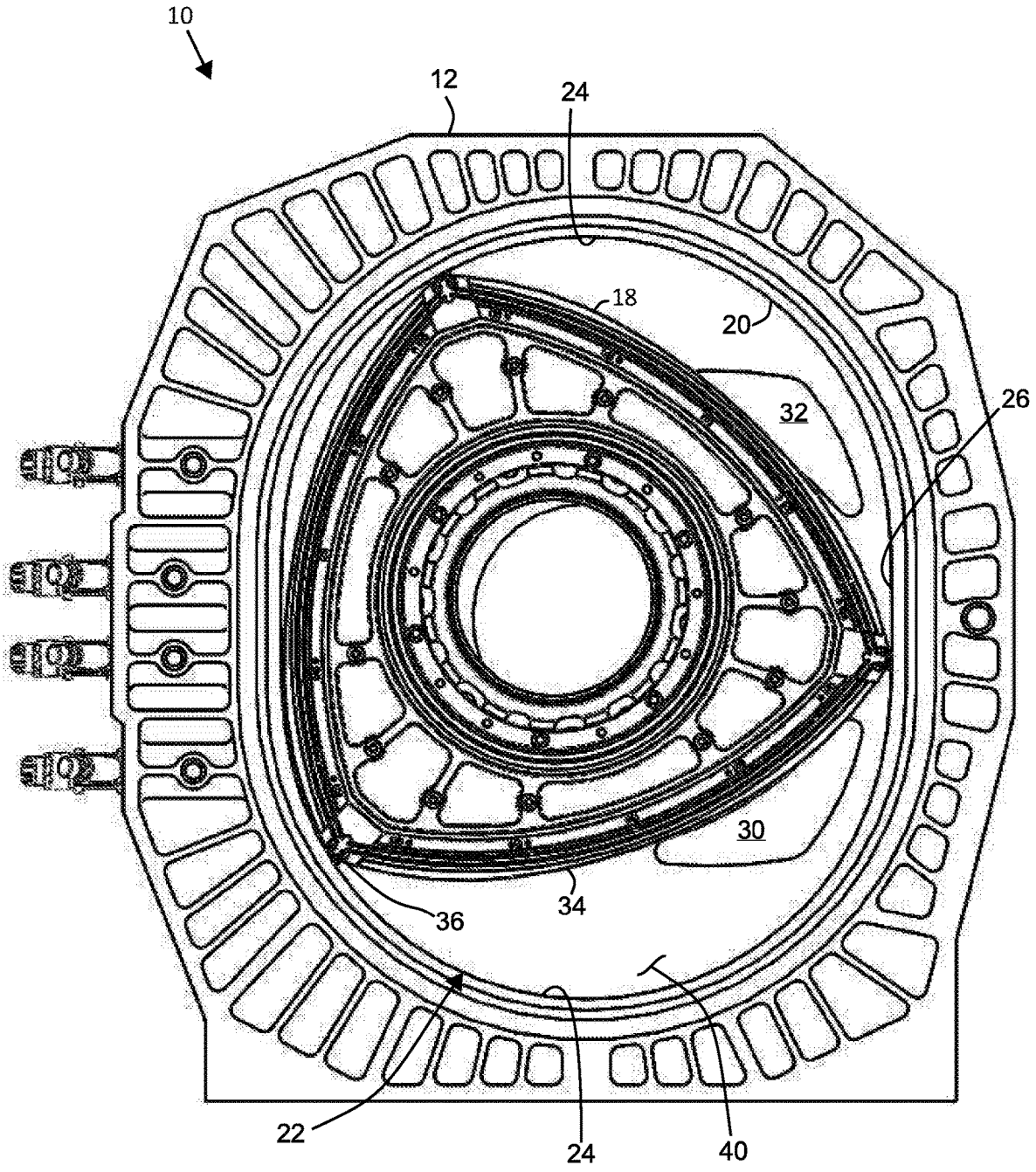
FIG. 1 is an elevational view of a high-compression, heavy-fuel, rotary engine depicting a space between a rotor flank and an interior wall of a chamber in an intake phase in accordance with an exemplary embodiment.
Figure 2:
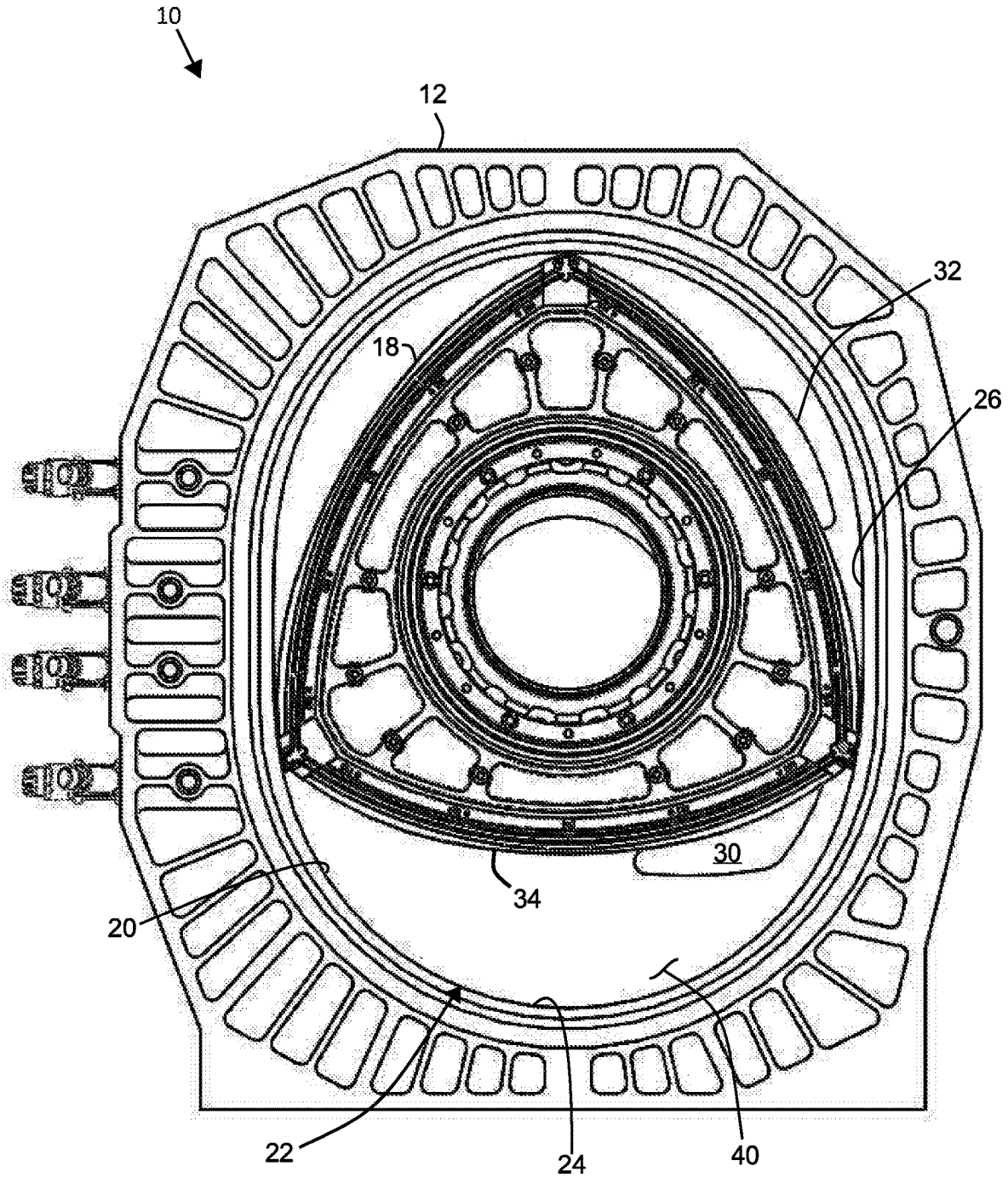
FIG. 2 is an elevational view of the rotary engine of FIG. 1 depicting a maximum volume of the space.

The subject matter of select exemplary embodiments is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about", "approximately", or "substantially" as used herein denote deviations from the exact value by +/−10%, preferably by +/−5% and/or deviations in the form of changes that are insignificant to the function.

With reference to FIGS. 1-10, an eccentric, high-compression, heavy fuel, rotary engine 10 is described in accordance with an exemplary embodiment. The rotary engine 10 starts and operates using compression-ignition of a heavy fuel without the use or need for a secondary ignition source like a spark plug or other internal or external ignition aid. The rotary engine 10 is described herein as being an eccentric rotary engine, but may also be referred to as a pistonless or a Wankel-style engine in that the engine 10 includes components and operational characteristics that are generally similar to known rotary engines like those developed by Dr. Felix Wankel and described in, for example, U.S. Pat. No. 2,988,065 to F. Wankel et al. But the engine 10 includes novel features not found in such prior designs that enable operation in ways deemed not practical or possible by such known designs.

The rotary engine 10 comprises a housing 12, a pair of end plates 14, 16, a rotor 18, and a drive shaft 19. The rotary engine 10 is described herein with respect to a single housing 12 and rotor 18, however it is foreseen that the rotary engine 10 may comprise multiple housings 12 and rotors 18 arranged to operate together. For example, in one embodiment a plurality of housings 12 and rotors 18 are disposed in series along the length of a single drive shaft 19 and are operated together to drive the drive shaft 19.

Figure 6:
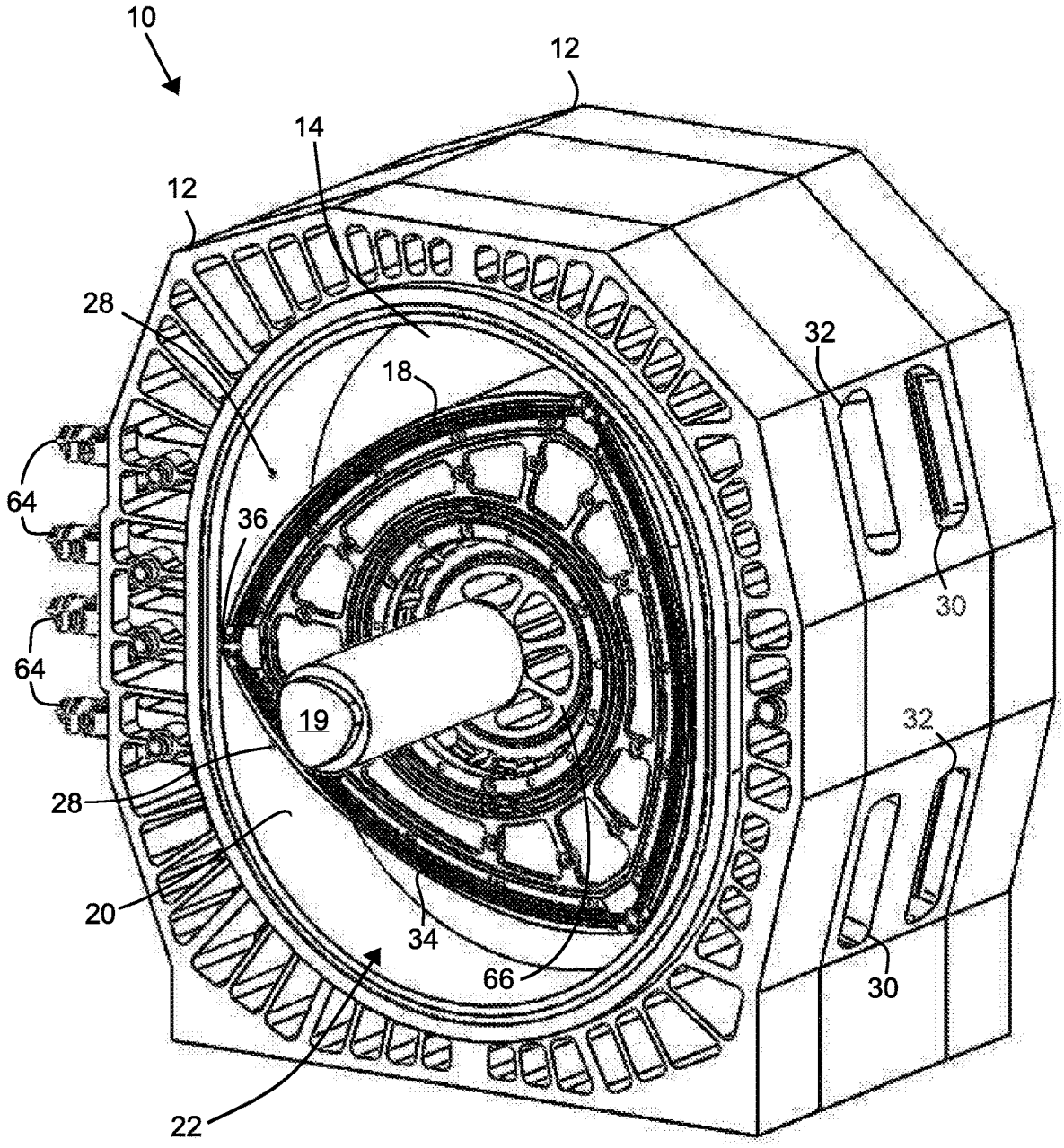
FIG. 6 is a perspective view of a high-compression, heavy-fuel, rotary engine depicted in accordance with an exemplary embodiment.
Figure 7:
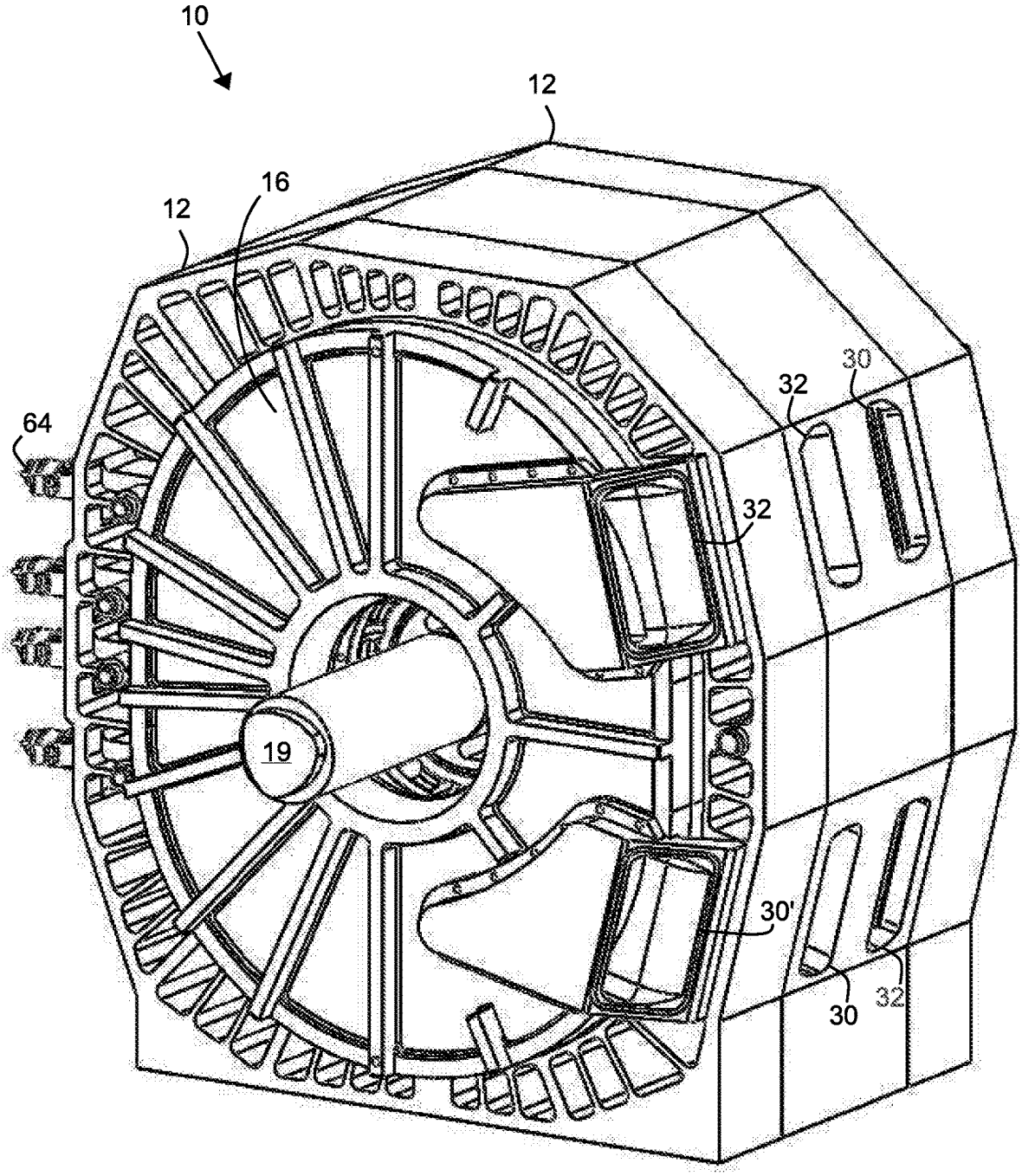
FIG. 7 is a perspective view of the rotary engine of FIG. 6 depicting an endplate with intake and exhaust ports in accordance with an exemplary embodiment.

As depicted in FIG. 6, the housing 12 is a generally planar component having a thickness that is just larger than a thickness of the rotor 18. The housing 12 includes an interior wall 20 extending parallel to the thickness of the housing 12 that forms an epitrochoidal-shaped, open-ended chamber 22. The epitrochoidal shape of the chamber 22 is somewhat elongated with rounded end portions 24 and linear, parallel side portions 26 connecting therebetween. The housing 12 may include a number of fuel injection ports 28 disposed along the interior wall 20 to align with associated regions within the chamber 22 as described more fully below. Intake and exhaust ports may also be provided along the interior wall 20 at desired locations.

The end plates 14, 16 couple to opposite faces of the housing 12 and enclose the chamber 22 therebetween. An intake port 30 and an exhaust port 32 are provided by the end plates 14 and/or 16; both the intake port 30 and the exhaust port 32 may be provided by the same end plate 14 or 16, or one port 30, 32 can be provided in each of the end plates 14 and 16. In one embodiment, the end plates 14 and 16 are identical and are thus interchangeable and their respective ports 30, 32 take an intake or exhaust function based on their position within the engine 10. In another embodiment, the placement and configuration of the intake port 30 and the exhaust port 32 in the end plates 14, 16 is such that the rotor 18 can be operated to rotate in either clockwise or counterclockwise direction with the ports 30 and 32 functioning for either intake or exhaust depending on the direction of rotation. One or both of the end plates 14, 16 may be configured to couple between two housings 12, as depicted in FIG. 6, or between the housing 12 and an intermediate component (not shown) in embodiments in which multiple housings 12 and rotors 18 are employed.

Figure 8:
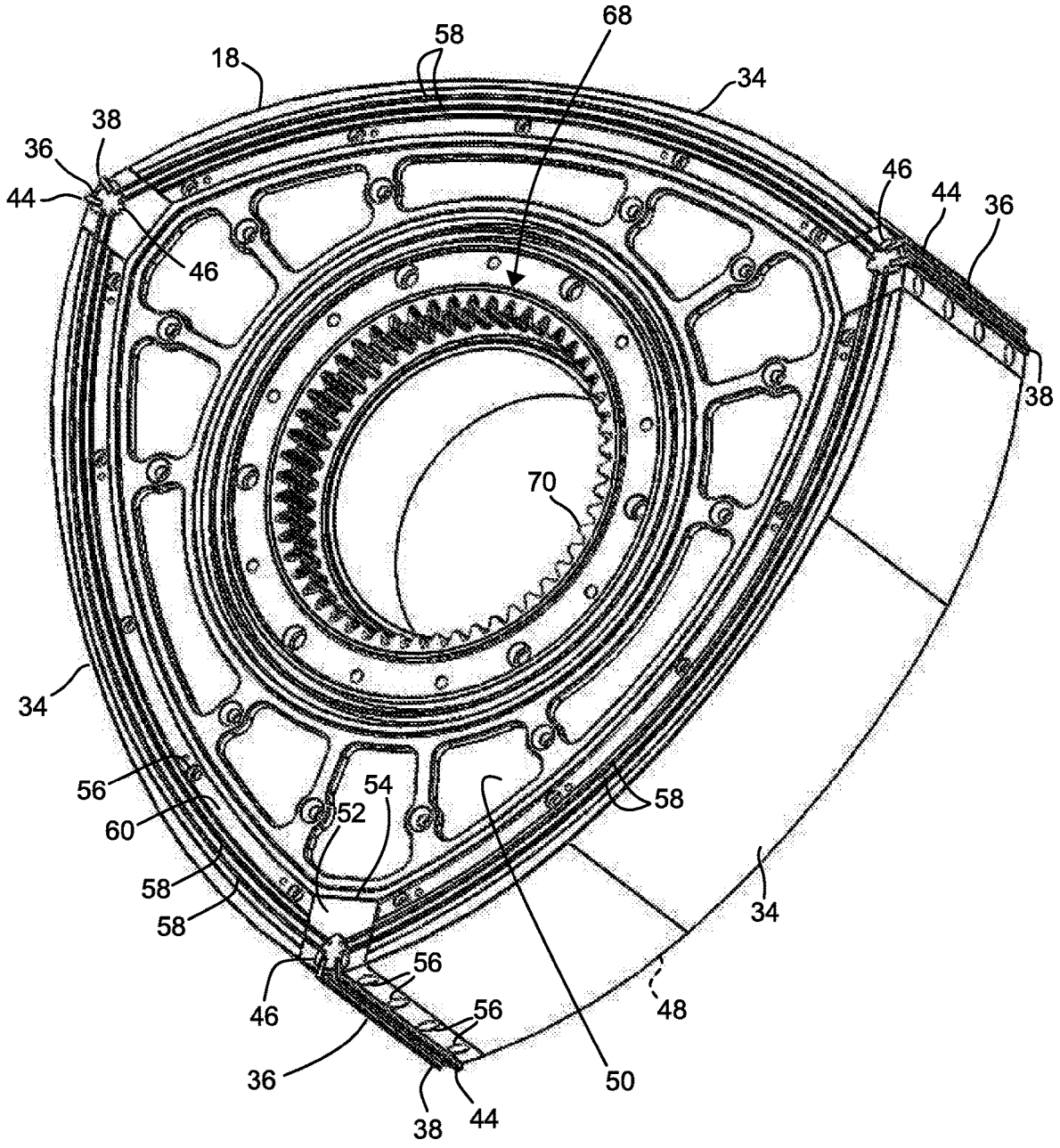
FIG. 8 is a perspective view of a rotor of the rotary engine of FIG. 6.

The rotor 18 comprises a generally planar component having three equal sides or flanks 34, respective pairs of which meet at respective apexes 36, as depicted in FIG. 8. The rotor 18 is configured with a thickness just less than that of the housing 12 such that the rotor 18 is disposable within the chamber 22 and between the end plates 14, 16. The flanks 34 are dimensioned to enable planetary rotational motion of the rotor 18 within the chamber 22 while maintaining the apexes 36 in very close and substantially constant proximity to the interior wall 20 at all times.

Figure 9:
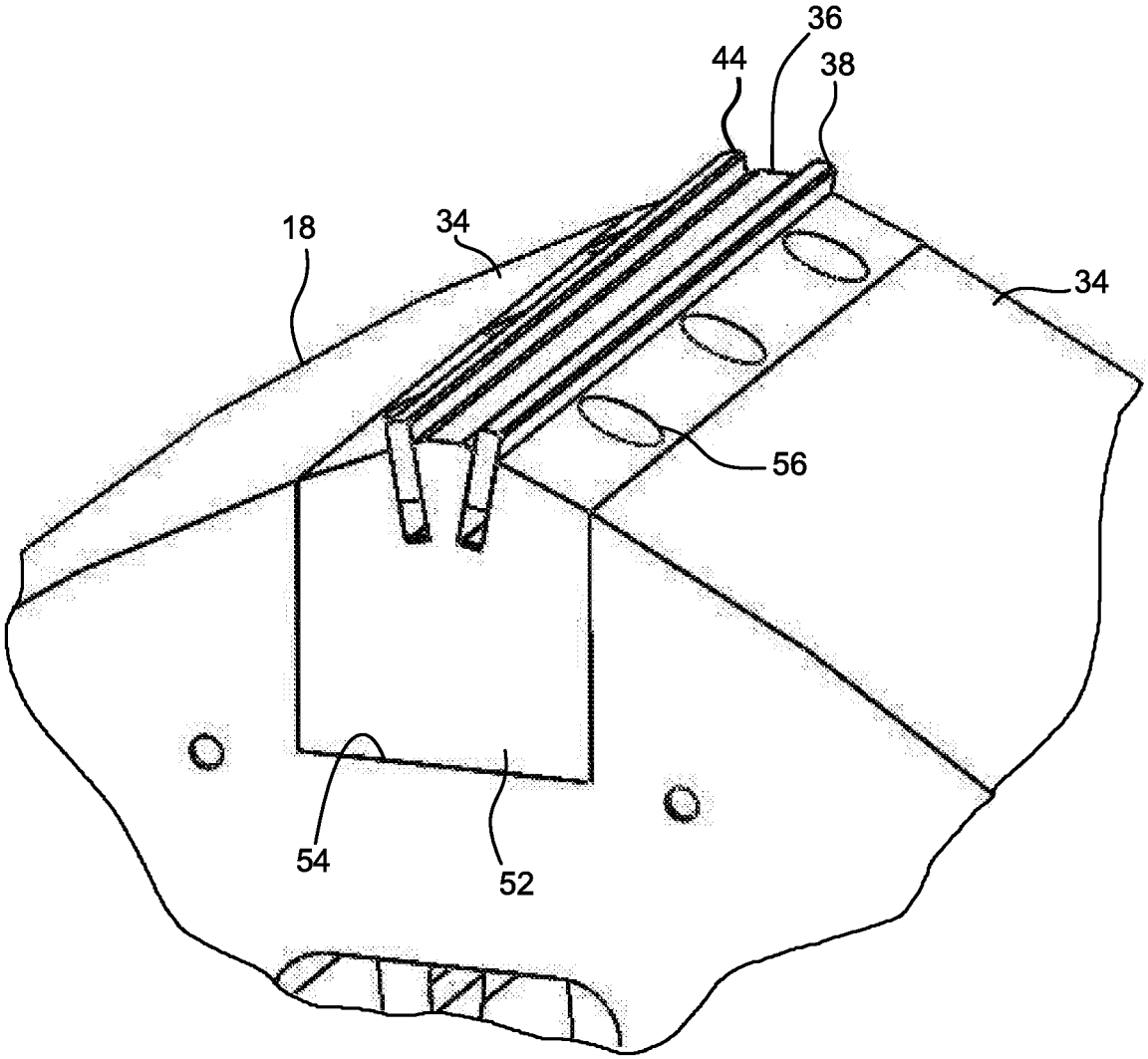
FIG. 9 is an enlarged partial perspective view of an apex of a rotor of FIG. 8 with some details removed for clarity.
Figure 10:
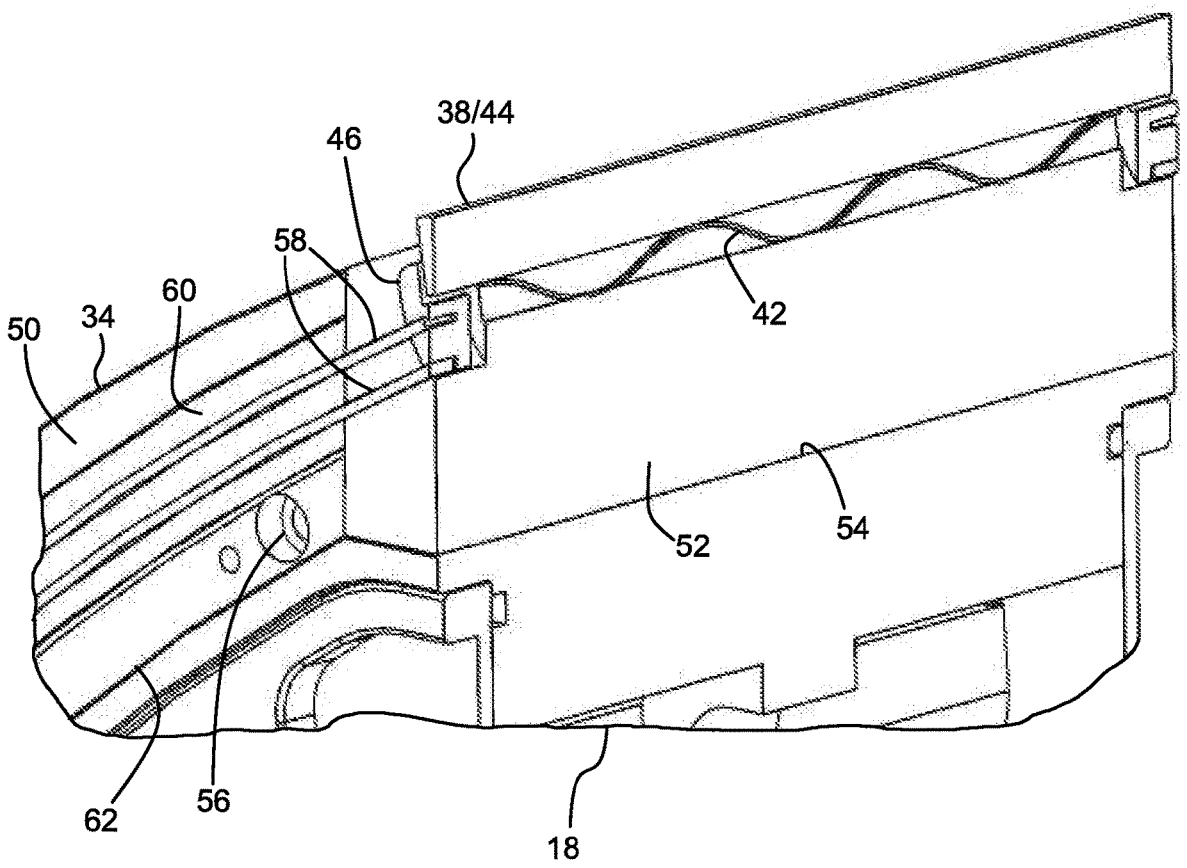
FIG. 10 is a cross-sectional, partial view of the rotor of FIG. 8.

With reference to FIGS. 8-10, apex seals 38 are provided at each apex 36 to seal opposite ends of a space 40 formed between the respective flank 34 and the interior wall 20. Each apex seal 38 comprises a rib of material that protrudes from the apex 38 a distance sufficient to engage the interior wall 20 in sliding contact and that extends substantially the thickness of the chamber 22 between the end plates 14, 16. The apex seal 38 may protrude a further distance and be at least partially bent, curved, or angled to maintain sliding contact with the interior wall 20. The apex seal 38 may include a biasing means 42 such as a spring or similar component configured to bias the seal 38 into sliding contact with the interior wall 20.

As depicted in FIGS. 8 and 9, a secondary apex seal 44 may be provided. In another embodiment, additional apex seals may be provided in addition to the apex seal 38 and the secondary apex seal 44. The secondary apex seal 44 is configured similarly to the apex seal 38 but is arranged in an orientation that is not parallel to the apex seal 38. For example, the secondary apex seal 44 protrudes in a slightly different direction than the apex seal 38. One or both of the apex seal 38 and the secondary apex seal 44 are preferably oriented with very little or no trailing angle, e.g., only slightly angled opposite the direction of rotation of the rotor 18 or aligned with a radius of the rotor 18. In one embodiment, one or both of the apex seal 38 and the secondary apex seal 42 are aligned with a trailing angle of less than about 10°, or less than about 5°, or between about 2° and 0°. Such an orientation may reduce an amount of a gas and heavy fuel mixture that is able to pass by the apex seals 38, 42 when under high compression.

A corner seal 46 is provided at or adjacent each apex 36 and protrudes from each end face 48, 50 of the rotor 18 in the direction of the thickness of the rotor 18. Each corner seal 46 overlaps or intersects the respective apex seal 36 and secondary apex seal 44.

The apex seals 38 and 44 and the corner seals 46 are coupled to the rotor 18 via a respective apex seal mounting block 52 which is removably disposed in a cutout 54 in the rotor 18 at a respective apex 36. The mounting block 52 is comprised of a material having a hardness that is greater than that of the body or remainder of the rotor 18 and that has greater wear resistance than, for example, the flanks 34 of the rotor 18. For example, the rotor 18 may be constructed from an aluminum alloy while the mounting blocks 52 are constructed from a high-strength, wear-resistant steel alloy. The mounting blocks 52 are coupled to the rotor 18 via a plurality of fasteners 56, such as bolts, screws, or the like. The cutout 54 and the mounting block 52 may also be formed with one or more complimentary surface features, such as mating flanges and slots, that engage or interlock to increase the strength of the coupling therebetween.

End faces 48, 50 of the rotor 18 are provided at opposite ends of the rotor thickness and lie in proximity to the respective end plates 14, 16. Side seals 58 are provided on each end face 48, 50 to seal between the respective end faces 48, 50 and end plates 14, 16. The side seals 58 extend along the end faces 48, 50 spaced apart from and generally following the contour of the flanks 34. Preferably, a pair of side seals 58 are provided spaced apart along the end faces 48, 50 and extending parallel to one another, however, any number of side seals 58 may be employed. The side seal 58 overlap and/or intersect the corner seals 46 at each apex 36. The side seals 58 may be biased to protrude from the end faces 48, 50 and into sliding contact with the respective end plate 14, 16.

The side seals 58 are disposed in side seal mounting blocks 60 which are removably coupled within a trough 62 formed in the end faces 48, 50 of the rotor 18, as depicted in FIG. 9. Like the apex seal mounting blocks 52, the side seal mounting blocks 60 may be constructed from a material having a greater hardness than that of the body of the rotor 18 to increase wear resistance. The side seal mounting blocks 60 are also similarly coupled to the rotor 18 via a plurality of fasteners 56 and may include surface features that compliment or mate with corresponding features formed within the trough 62 to increase the strength of the coupling.

One or more fuel injectors 64 are installed on the housing 12 in communication with each of the fuel injection ports 28. The fuel injectors 64 are configured to provide a heavy fuel into the chamber at high pressures and may employ a common rail-type high-pressure manifold. In one embodiment, the heavy fuel is provided at a pressure between about 300 pounds per square inch (psi) and greater than about 30,000 psi, or at about 15,000 psi, or about 26,000 psi.

Referring again to FIG. 6, the drive shaft 19 comprises an elongate shaft having a lobe 66 extending radially outward about a portion of the circumference of the drive shaft 19 and offset to one side from a rotational axis of the drive shaft 19. The drive shaft 19 is installed through apertures in the end plates 14 and 16 and the rotor 18 such that the lobe 66 is aligned within a central aperture 68 in the rotor 18. The central aperture 68, the rotor 18, and the lobe 66 are coaxially aligned which offsets the rotational axis of the rotor 18 from that of the drive shaft 19. The central aperture 68 of the rotor 18 includes a ring gear or similar toothed portion 70 that meshes with a static gear coupled to one of the end plates 14, 16 and through which a non-lobed portion of the drive shaft 19 also passes. Thereby, rotation of the rotor 18 or of the drive shaft 19 moves the rotor 18 in a planetary rotational motion about the static gear.

With reference now to FIGS. 1-5, operation of the rotary engine 10 is described in accordance with an exemplary embodiment. As discussed previously, the rotary engine 10 is an eccentric or Wankel-style rotary engine and operation thereof generally follows that of a Wankel-style rotary engine. As such, the spaces 40 between each flank 34 and the interior wall 20 of the chamber 22 move and change shape and size as the rotor 18 rotates within the chamber 22. And each space 40 is undergoing a different portion of the combustion cycle relative to the other spaces 40 at any given time. For simplicity of explanation, only one space 40 is described herein although one of skill in the art will recognize the applicability of this description to each of the other spaces 40 as they too move through the same regions within the chamber 22.

Beginning initially with an intake phase of the rotary engine 10 operation, the rotor 18 is positioned such that the intake port 30 in the end plate 14 is open to the space 40, as depicted in FIG. 1. As the rotor 18 rotates (clockwise as depicted in FIGS. 1-5) the space 40 also moves clockwise around the chamber 22 and draws air in through the intake port 30 until reaching a maximum volume, $V_{max}$, FIG. 2, as the rotor 18 moves over and closes off the intake port 30.

When initiating operation or starting the rotary engine 10, the drive shaft 19 is rotated to drive initial rotation of the rotor 18. Conversely, after operation of the rotary engine 10 is initiated, the combustion process of the rotor 18 drives the rotation of the drive shaft 19 as described below. The initial rotation of the drive shaft 19 may be provided by a second gasoline or heavy-fuel rotary or reciprocating engine, an electric motor, or a hand-operated mechanism, among others. However, the initial combustion within the rotary engine 10 is produced by compression-ignition of a heavy-fuel within the rotary engine 10 alone and without a secondary ignition source or aid.

The intake air may be drawn into the space 40 by movement of the rotor 18 or one or more compression systems, air injection systems, or other aids may be associated with the rotary engine 10 to compress and or force additional air into the space 40 through the intake port 30. For example, one or more turbo-charger or super-charger systems among other compression systems can be employed. The compression systems may be driven by the rotary engine 10 or may be driven or powered by a separate power source which may include a second rotary engine, a gasoline or heavy-fuel piston engine, an electric motor, or the like. In one embodiment, a second intake port 30' (FIG. 7) through which the compressed air from the compression system is forced into the space 40 is provided. The second intake port 30' may be configured like the intake port 30 to be closed by the rotor 18 or can include another valve or shutoff means. Additionally, the air may be preheated and/or combined with other gases or fluids prior entering the space 40 to affect characteristics such as the temperature, pressure, and/or flammability of the air.

Figure 3:
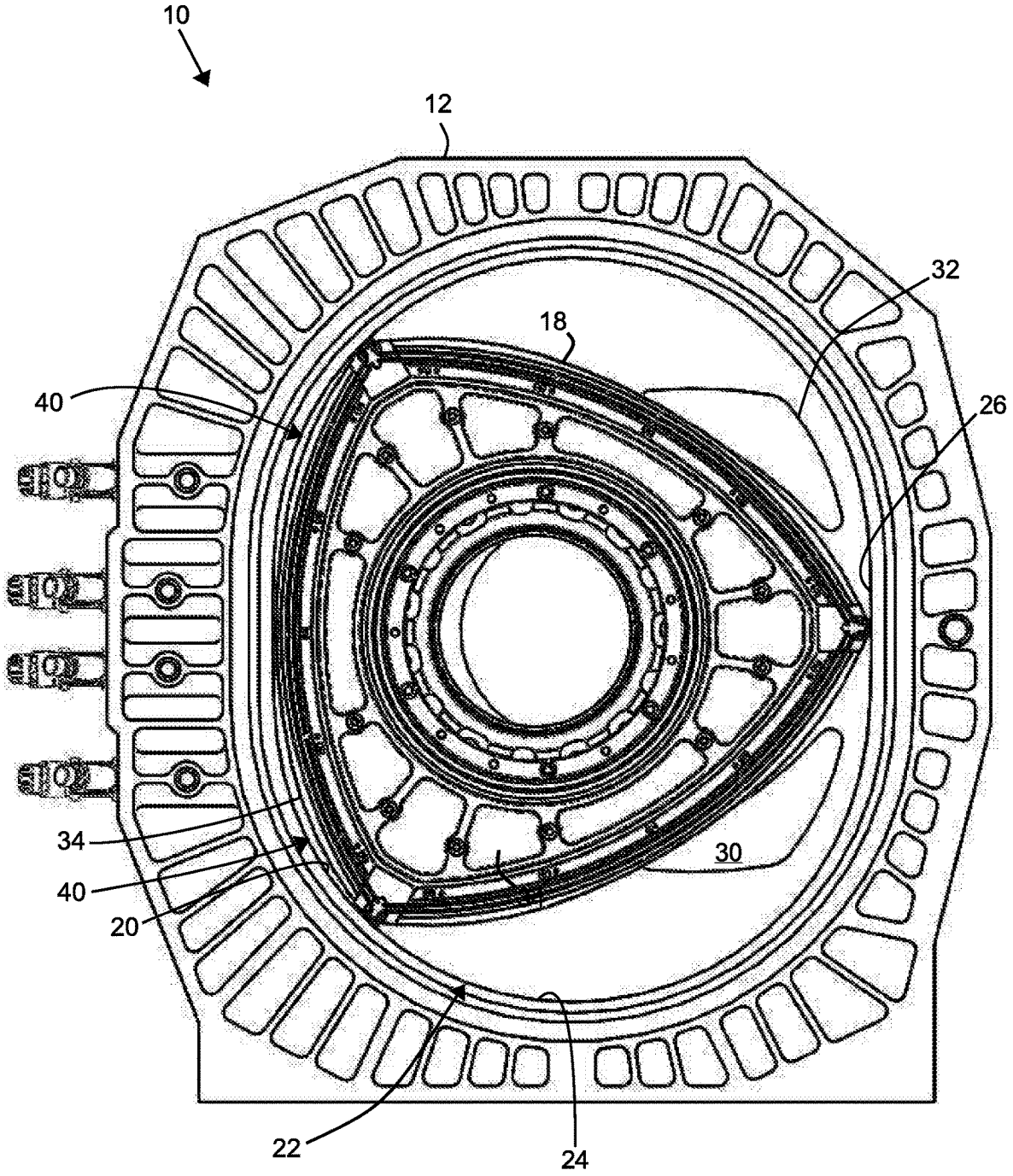
FIG. 3 is an elevational view of the rotary engine of FIG. 1 depicting the space in a compression phase with a minimum volume.

As the rotor 18 continues its rotation, the space 40 enters a compression phase in which the volume of the space 40 is decreased thereby compressing the air contained therein. Compression continues until reaching a minimum volume, $V_{min}$, of the space 40, as depicted in FIG. 3. A heavy fuel such as diesel, Jet-A, Jet-A1, JP-5, and JP-8, among others is injected via the fuel injectors 64 into the space 40 just before and/or as the space 40 reaches its minimum volume to provide a fuel-air mixture. The heavy fuel is injected at very high pressures, e.g., greater than 300 psi or preferably around 26,000 psi, which may provide an atomized spray with a high surface to volume ratio with increased combustion properties and may further increase the pressure within the space 40. One or more fuel injectors 64 may be employed at various locations along the interior wall 20 that align with the space 40 when in the compression phase. The fuel injectors 64 may be further configured to provide the fuel into the space 40 at one or more different times relative to the rotation or position of the rotor 18 and may be directed to spray in one or more different directions or into one or more different areas within the space 40.

Compression of the fuel-air mixture in the space 40 generates heat and pressure sufficient to cause the fuel injected therein to ignite under compression-ignition without the use of a secondary ignition source such as a spark from a spark-plug or a high temperature surface such as a glow-plug. The ratio between the maximum volume and the minimum volume, e.g., the compression ratio provided is greater than about 13:1 which is known to be able to support compression-ignition. Preferably, the compression ratio is greater than about 15:1, or greater than ratios of about 18:1, 20:1, 25:1, or 30:1, among other ratios within or greater than these ranges. Although, particular compression ratio values are provided herein, it is to be understood that all ratios greater that 13:1, e.g. 15:1, 17:1, etc. are within the scope of this disclosure.

Such compression ratios are obtained, at least in part, by the configuration of the interior wall 20 of the chamber 22 and the corresponding configuration of the flanks 34 of the rotor 18. As discussed previously above, the interior wall 20 includes side portions 26 that are linear. Additionally, the flanks 34 of the rotor 18 are substantially continuous smooth surfaces that extend between the apexes 36. As such, the volume between the interior wall 20 and the flank 34 is minimized and thus the compression ratio is maximized. In contrast, known designs provide side portions of the chamber that bow or pinch inward and flanks of the rotors include recesses, troughs, or similar depressions that extend into the body of the rotor. These features limit the ability of the volume of the space to be minimized and thus the air therein to be compressed. Such known designs thus cannot achieve high-pressures or compression ratios sufficient to support true compression-ignition of heavy-fuels without the use of a secondary ignition source or aid.

Figure 4:
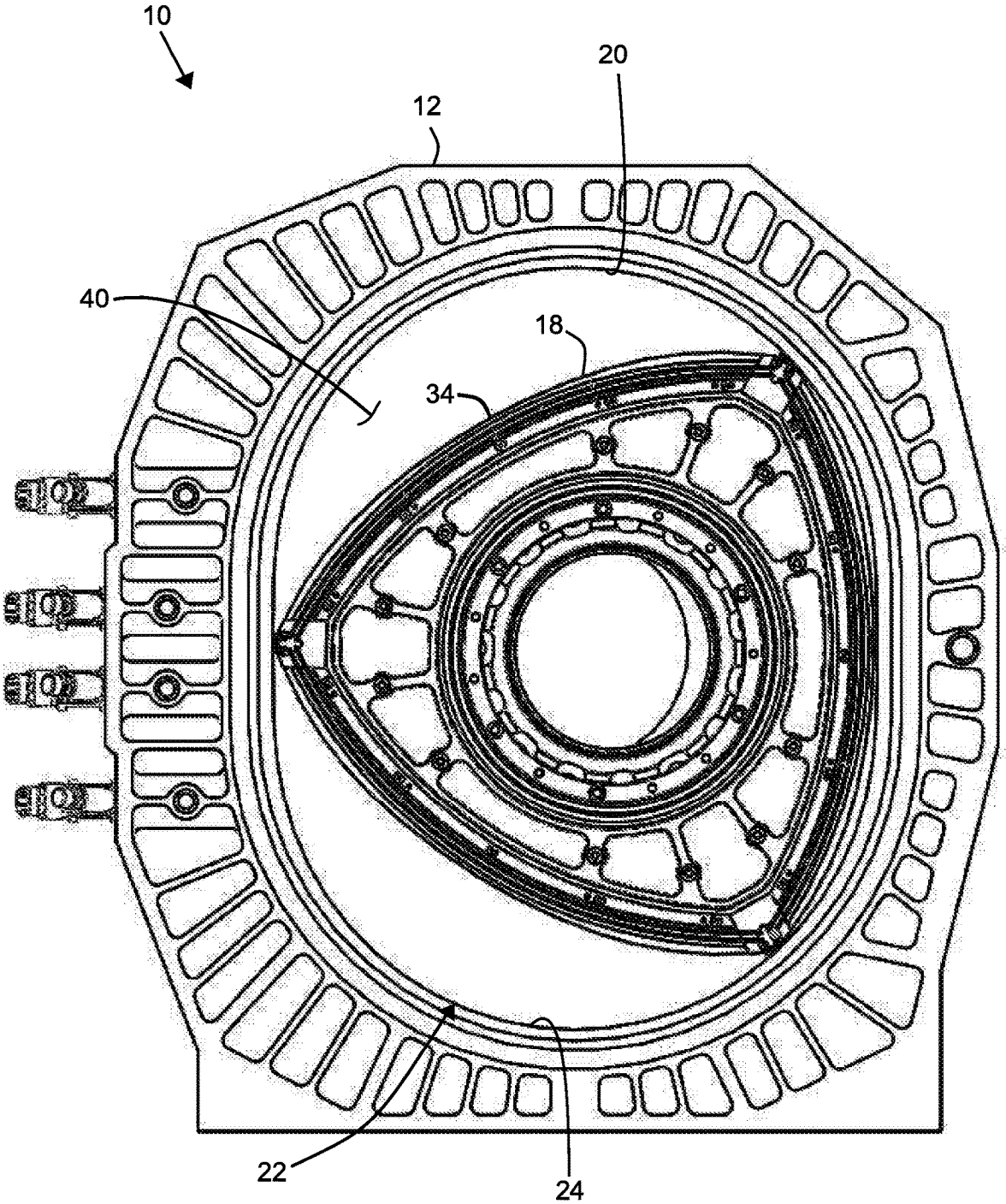
FIG. 4 is an elevational view of the rotary engine of FIG. 1 depicting the space in an expansion phase.
Figure 5:
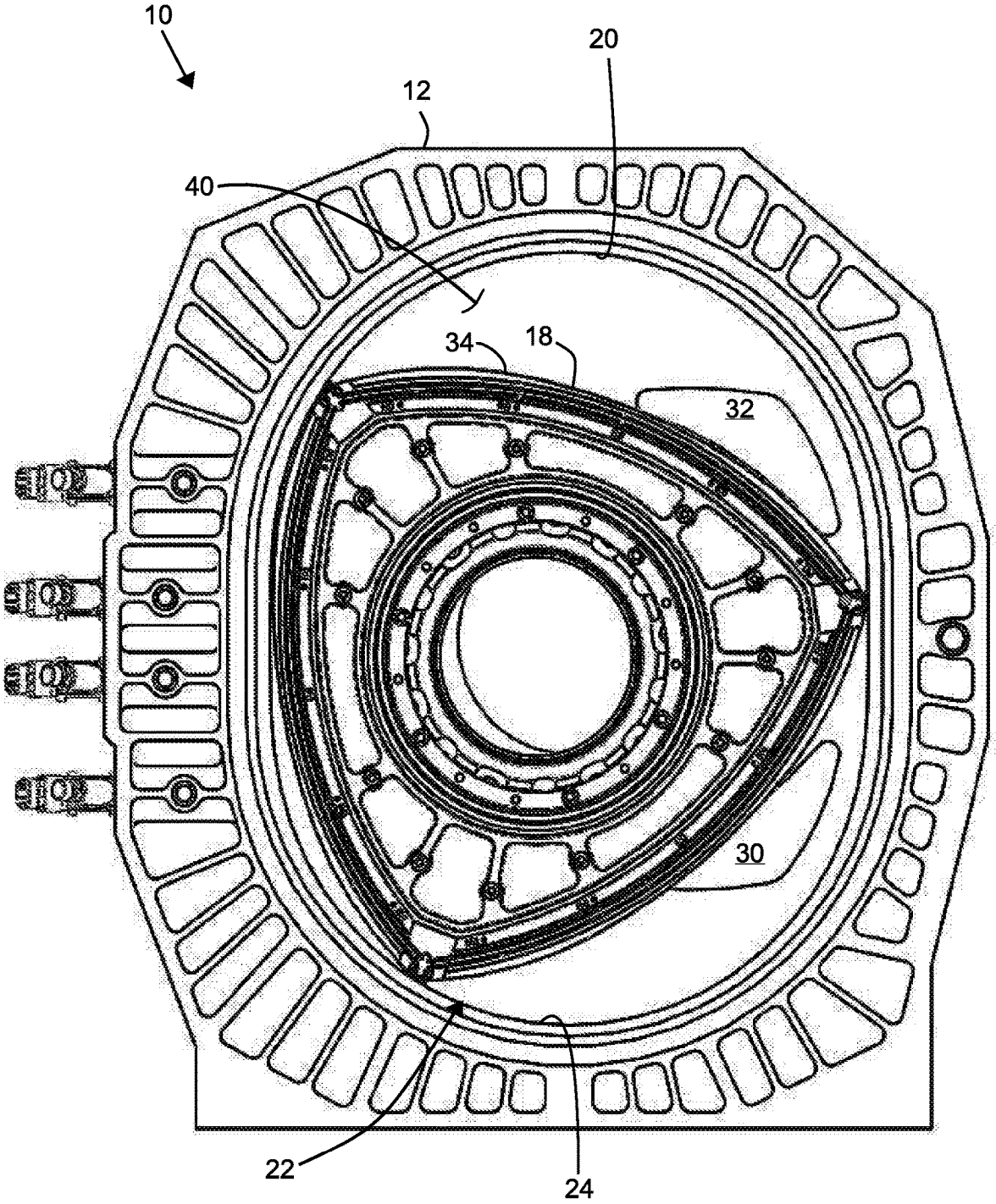
FIG. 5 is an elevational view of the rotary engine of FIG. 1 depicting the space in an exhaust phase.

Combustion of the heavy-fuel and air mixture in the space 40 moves the space 40 through an expansion phase, as depicted in FIG. 4. The combustion applies a force on the rotor 18 that drives the planetary rotational motion thereof and thus drives rotation of the drive shaft 19. Rotation of the rotor 18 and expansion of the space 40 continues until the rotor 18 begins to move past or over the exhaust port 32 which allows the combusted fuel-air mixture to be expelled through the port 32 in an exhaust phase, depicted in FIG. 5. Rotation of the rotor 18 continues to close off the space 40 from the exhaust port 32 and to open the space 40 to the intake port 30 (FIG. 1) at which point the cycle begins again.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A rotary engine, comprising:

a rotor housing comprising an epitrochoid-shaped chamber having linear side portions that extend parallel to one another and between opposing rounded end portions, the linear side portions free from inwardly-extending surfaces;

a rotor disposed in the epitrochoid-shaped chamber, the rotor comprising three flanks and three apexes, respective pairs of the flanks meeting at respective apexes, the rotor defining a space in the epitrochoid-shaped chamber having a maximum volume and a minimum volume to define a compression ratio of at least about 13:1 for a compression phase of compressing the space from the maximum volume to the minimum volume; and a plurality of fuel injection ports located on an interior wall of the rotor housing to align with the space during the compression phase.

2. The rotary engine of claim 1, comprising an apex seal at an apex of the three apexes.

3. The rotary engine of claim 1, comprising a plurality of rotors including the rotor.

4. The rotary engine of claim 3, wherein the plurality of rotors are disposed in series along a length of a drive shaft to drive the drive shaft.

5. The rotary engine of claim 1, comprising a drive shaft coupled with the rotor.

6. The rotary engine of claim 5, comprising a lobe aligned with an aperture of the rotor.

7. The rotary engine of claim 1, comprising a first endplate and a second endplate coupled to the rotor housing on opposing ends of a thickness of the rotor housing and enclosing the epitrochoid-shaped chamber.

8. The rotary engine of claim 7, comprising a gear coupling the rotor with a static gear coupled to the first endplate to enable planetary rotational motion of the rotor about the static gear.

9. The rotary engine of claim 1, comprising:

a drive shaft coupled with the rotor; and a motor coupled with the drive shaft to cause initial rotation of the drive shaft.

10. A system, comprising:

a rotor housing comprising an epitrochoid-shaped chamber having linear side portions that extend parallel to one another and between opposing rounded end portions, the linear side portions free from inwardly-extending surfaces;

a rotor disposed in the epitrochoid-shaped chamber, the rotor defining a space in the epitrochoid-shaped chamber having a maximum volume and a minimum volume to define a compression ratio of at least about 13:1 for a compression phase of compressing the space from the maximum volume to the minimum volume;

a plurality of fuel injection ports located on an interior wall of the rotor housing to align with the space during the compression phase;

a first endplate and a second endplate coupled to the rotor housing on opposing ends of a thickness of the rotor housing; and a drive shaft extending through the rotor, the first endplate, and the second endplate, the drive shaft rotationally coupled with the rotor.

11. The system of claim 10, comprising:

a motor coupled with the drive shaft to cause initial rotation of the drive shaft.

12. The system of claim 10, comprising:

an apex seal coupled with an apex of the rotor to seal a space between the rotor and the epitrochoid-shaped chamber.

13. The system of claim 10, comprising:

the rotor comprises three flanks such that movement of the rotor in the epitrochoid-shaped chamber successively forms an intake volume and a compressed volume corresponding to the compression phase between each of the three flanks and the interior wall.

14. The system of claim 13, wherein the three flanks of the rotor are continuous smooth surfaces.

15. The system of claim 10, comprising a gear coupling the rotor with a static gear coupled to the first endplate to enable planetary rotational motion of the rotor about the static gear.

16. The system of claim 10, comprising an intake port and an exhaust port in the epitrochoid-shaped chamber.

* * * * *